United States Patent [19]

Pratt et al.

[11] Patent Number: 4,494,601

[45] Date of Patent: Jan. 22, 1985

[54] DOWNHOLE CHEMICAL CUTTING TOOL

[75] Inventors: Donna K. Pratt; Jamie B. Terrell, both of Fort Worth, Tex.

[73] Assignee: Gearhart Industries, Inc., Fort Worth, Tex.

[21] Appl. No.: 301,675

[22] Filed: Sep. 14, 1981

[51] Int. Cl.[3] ..... E21B 29/02

[52] U.S. Cl. ..... 166/55; 166/63; 166/297; 166/212; 29/525

[58] Field of Search ..... 166/55, 55.1, 55.2, 166/63, 110, 120, 153, 156, 169, 212, 286, 297, 298, 299; 29/525; 92/85 R

[56] References Cited

U.S. PATENT DOCUMENTS

| | | | |
|---|---|---|---|
| 2,140,072 | 12/1938 | Chenault | 166/169 |
| 2,918,125 | 12/1959 | Sweetman | 166/315 |
| 3,678,808 | 7/1972 | Hsu et al. | 92/85 R |
| 4,114,930 | 9/1978 | Perkins et al. | 29/525 |
| 4,125,161 | 11/1978 | Chammas | 166/297 |
| 4,180,131 | 12/1979 | Chammas | 166/55 |
| 4,250,960 | 2/1981 | Chammas | 166/55 |
| 4,299,287 | 11/1981 | Vann et al. | 175/4.56 |
| 4,345,646 | 8/1982 | Terrell | 166/55 |

*Primary Examiner*—Stephen J. Novosad
*Assistant Examiner*—William P. Neuder
*Attorney, Agent, or Firm*—Richards, Harris, Medlock & Andrews

[57] ABSTRACT

A downhole chemical cutting tool having an improved cutting section. The tool comprises an elongated tool body adapted for insertion into a well bore and includes anchoring means actuatable between a deployed position in response to the application of fluid pressure and a retracted position in response to the release of such pressure. The tool further includes a chemical section and a cutting section located in front of the chemical section. The cutting section has a longitudinally extending bore which is in fluid communication with the chemical section at the rear of the cutting section and in fluid communication with the exterior of the tool body at the front of the cutting section. The cutting section is provided with one or more cutting ports through which the cutting fluid passes when the tool is fired. A piston is slidably disposed in the bore of the cutting section at a location between the ports and the chemical section. When the tool is fired, the fluid pressure developed sets the anchoring means and forces the piston forward, exposing the port to the cutting fluid flowing into the bore from the chemical section. The tool further comprises means in the cutting section in front of the port to receive the piston upon the application of fluid pressure in the tool to lock the piston in place at a location in front of the cutting port. The locking means may take the form of a reduced section in the cutting tool bore which is adapted to receive a portion of the piston in a swedged relationship.

19 Claims, 4 Drawing Figures

DOWNHOLE CHEMICAL CUTTING TOOL

BACKGROUND OF THE INVENTION

This invention relates to downhole well tools and more particularly to downhole chemical cutting tools.

There are many circumstances in the oil industry where it is desirable to cut or completely sever downhole tubular goods within a well. For example, in the course of drilling a well, drill pipe may become stuck or "frozen" at a location well below the surface of the earth. This may result, for example, from "key seating" in which a drill collar or other section of the drill string becomes lodged against the side of the well, or the drill string may become stuck as a result of cuttings which settle within the well around the lower portion of the drill string. Similarly, in the completion or operation of oil or gas wells, it is often necessary to carry out downhole cutting operations. For example, it may be desirable to sever casing or tubing at a downhole location in order to make repairs or to withdraw the tubing or casing from a well which is being abandoned.

In other circumstances, it is desirable to cut slots, grooves or perforations in downhole tubular goods. For example the perforating of the casing and the surrounding cement sheath to provide fluid access to a hydrocarbon bearing formation is a conventional expedient. Similarly it is often desirable to perforate tubing in the completion or recompletion of a well.

While mechanical means may be employed to cut openings or to completely sever downhole tubular goods, this is often accomplished through chemical cutting techniques. Many times shaped charges are employed to perforate or sever tubular goods within the well. However, another technique which can often be used to great advantage is the application of a chemical which cuts through metal tubular goods in the well by direct chemical reaction. For example U.S. Pat. No. 2,918,125 to Sweetman discloses a downhole chemical cutter in which halogen fluorides are employed in jet cutting streams. The attendant reaction is highly exothermic and the tubing, drill pipe, etc. is rapidly penetrated.

During the course of the cutting operation, it is desirable to anchor the cutting tool at the desired location within the well. This is particularly the case where the cutting tool is run into the well on a wire line. One technique for anchoring the tool employs use of fluid pressure from a suitable source to both activate the anchoring means and to dispell cutting fluid from the tool against the surface to be severed or otherwise cut. For example, U.S. Pat. No. 4,125,161 to Chammas discloses a cutting tool in which gas from a propellant charge displaces a piston to cam one or more wedges outwardly against the tubing string or other object to be cut. The gas from the propellant charge is also employed to force the cutting chemical into contact with a preignitor and thence downwardly through the bore of a severing head. The severing head is provided with discharge parts through which the chemical issues, and circulation ports at the lower end of the severing-head bore. A piston in the bore is disposed adjacent to the discharge ports, but does not close these ports with respect to the lower portion of the bore and the circulation ports. The chemical under pressure forces the piston downwardly until it abuts against a shoulder formed by a reduction in the severing head bore. In this portion, the piston is below the discharge ports and the chemical flows outwardly through these ports into contact with the tubular goods.

A particularly effective chemical cutting tool is disclosed in U.S. patent application Ser. No. 078,472 filed Sept. 24, 1979 by Jamie B. Terrell. In this tool a chemical module assembly is located intermediate a propellant and slip assembly and a discharge head assembly. Gas pressure generated by the ignition of a propellant charge is employed to rapidly move a slip array against a slip expander, during which time the cutting action takes place. The slip array is then rapidly retracted by means of a biasing mechanism. The gas pressure also forces chemical from the chemical module assembly into the discharge head assembly having a central bore which is equipped with discharge ports similarly as described above, but which is closed at its lower end. The chemical forces a piston, which normally closes the discharge ports, downwardly, thus opening the ports to the chemical.

SUMMARY OF THE INVENTION

In accordance with the present invention there is provided a new chemical cutting tool having an improved cutting section. The cutting tool of the present invention comprises an elongated tool body adapted for insertion into a well bore. The tool body includes anchoring means which are actuatable between a deployed position in response to the application of fluid pressure and a retracted position in response to the release of such pressure. The tool body further comprises a chemical section having a chamber therein adapted to receive a cutting fluid and a cutting section located in front of the chemical section. The cutting section has a longitudinally extending bore which is in fluid communication with the chemical section at the rear of the cutting section and in fluid communication with the exterior of the tool body at the front of the cutting section. The wall of the cutting section is provided with at least one cutting port extending transversely from the bore to the exterior of the tool body. The cutting port is at an intermediate location in the cutting section and provides for the issuance of the cutting fluid from the tool when the tool is fired. A piston is slidably disposed in the bore of the cutting section at a location between the port and the chemical section. Thus when the tool is fired, the fluid pressure developed sets the anchoring means and forces the piston downwardly, exposing the port to the cutting fluid flowing into the bore from the chemical section. The tool further comprises means in the cutting section in front of the port to receive the piston upon the application of fluid pressure in the tool to hold the piston in place at a location in front of the cutting port.

In a preferred embodiment of the invention the means to hold the piston comprises a reduced section in the cutting tool bore which is adapted to receive a portion of the piston. This section of the bore is smaller than the piston and is dimensioned with respect to the piston to receive the piston in a wedged relationship. Preferably the front face of the piston is tapered to facilitate the entry of the piston into the reduced section of the bore.

In a further embodiment of the invention a sleeve is positioned in the bore in front of the piston. The sleeve is provided with packing means which functions to seal the cutting port from the front portion of the bore.

In yet a further aspect of the invention the rear surface of the piston facing the chemical section is tapered to provide a configuration which enhances flow of the chemical cutting fluid through the cutting port.

DESCRIPTION OF PREFERRED EMBODIMENTS

The present invention provides an improved cutting head design for downhole chemical cutting tools. The cutting head is suitable for use in chemical fluid jet cutting tools having anchoring means actuated by fluid pressure and enables rapid deployment and retraction of such means with a decreased likelihood of hanging up the tool within a well. The invention is particularly well adapted for use in downhole chemical fluid jet cutting tools of the type disclosed in the aforementioned application by Terrell and the invention will be described in detail with reference to such tools.

Figure 1:
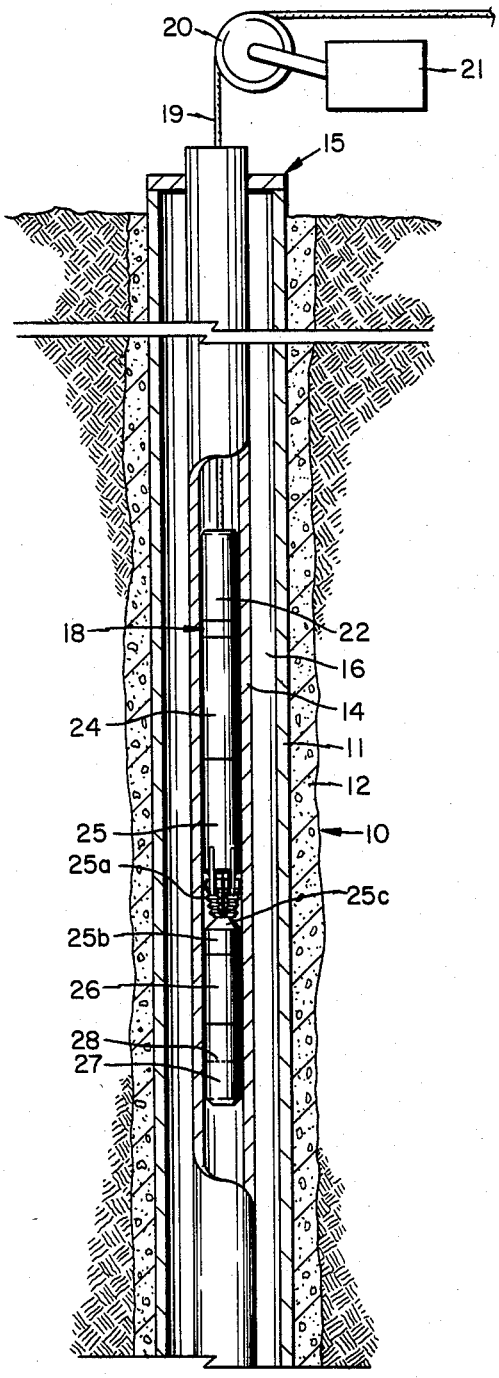
FIG. 1 is an illustration, partly in section, showing a downhole chemical cutter located in a well.

Turning first to FIG. 1 of the drawing, there is illustrated a chemical cutting tool embodying the present invention disposed within a well extending from the surface of the earth to a suitable subterranean location, e.g. an oil and/or gas producing formation (not shown). More particularly and as is illustrated in FIG. 1, a wellbore 10 is provided with a casing string 11 which is cemented in place by means of a surrounding cement sheath 12. A production tubing string 14 is disposed in the well as illustrated and extends from the well head 15 to a suitable downhole location. The tubing string and/or the annular space 16 between the tubing and the casing may be filled with high pressure gas and/or a liquid such as oil or water. Alternatively the tubing string or the annulus may be "empty", i.e. substantially at atmospheric pressure.

As further illustrated in FIG. 1, there is shown a chemical cutting tool 18 which is suspended from a cable (wire line) 19. The cable 19 passes over suitable indicating means such as a measuring sheave 20 to a suitable support and pulley system (not shown). The measuring sheave produces a depth signal which is applied to an indicator 21 which gives a readout of the depth of which the tool is located. It will, of course, be recognized that the well structure illustrated is exemplary only and that the cutting tool can be employed in numerous other environments. For example instead of a completed well, the tool can be employed in severing a drill pipe in either a cased or uncased well. In this case the tubing string shown would be replaced by a string of drill pipe.

The chemical cutter 18 is composed of five sections. At the upper end of the tool there is provided a fuse assembly 22 comprised of a firing adaptor, firing sub and an electrically activated fuse. Immediately below the fuse assembly 22 is a propellant section 24 which provides a source of high pressure gas. For example the propellant section may take the form of a chamber containing power pellets such as gun powder which burns to produce the propellant gases. Immediately below the propellant section 24 is a section 25 comprising means for anchoring the tool body in the tubing string. The anchoring means takes the form of a slip array 25*a* comprising a plurality of slip segments. The slip array is slidably disposed on a central shaft to which a slip expander 25*b* having a tapered surface 25*c* is secured. The slip array is moved downwardly by means of an actuator having a piston-cylinder type configuration. The activator and the connected slip array move downwardly against suitable biasing means such as a compression spring. A chemical module section 26 is located below the slip assembly. This section contains a suitable chemical cutting agent such as a halogen fluoride. Normally the chemical cutting agent will take the form of bromine trifluoride. Immediately below the chemical section is a cutting assembly 27. This section contains an "ignitor hair" such as steelwool which activates the halogen fluoride. The cutting assembly also contains cutting ports through which the fluid is directed against the interior wall of the tubing. In this case, the cutting section is equipped with ports 28 extending about the periphery thereof to completely sever the tubing in the well.

The operation of the chemical cutting tool may be described briefly as follows. The tool is run into the well on the wire line 19 to the desired depth at which the cut is to be made. An electrical signal is then sent via wire line 19 to the cutter tool where it sets off the fuse, in turn igniting the power pellets. As these pellets burn, a high pressure gas is generated and travels downwardly through a passageway in the central shaft of the slip section. The resulting application of pressure against the slip assembly actuator forces the slip array downwardly over surface 25*c* to move the slip segments outwardly to the deployed position where they grip the inner surface of the tubing. The slip array thus anchors the cutter in the tubing. As the gas pressure further increases, shear diaphragms within the chemical module are ruptured and the halogen fluoride is forced through the ignitor hair which pre-ignites the chemical. The gas pressure then forces the activated chemical into the cutting section and ultimately outwardly through ports 28. In a short period of time, normally less than a second, the tubing is severed and the slip array is retracted as the fluid pressure in the tool is released and allows the slip array to move upwardly under the action of the biasing means. The tool can then be withdrawn from the borehole. For a further description of the general operating conditions and parameters employed in the tool, reference may be made to the aforementioned application Ser. No. 078,472 by Terrell, the disclosure of which is incorporated herein by reference. Yet another chemical cutting tool having an improved anchoring assembly is disclosed in U.S. patent application Ser. No. 286,146 filed July 23, 1981 by Donna K. Pratt and Jamie B. Terrell, the disclosure of which is incorporated herein by reference.

In chemical-cutting tools of the type discussed, it is often desirable to provide a movable piston which is positioned so as to separate the cutting ports from the chemical section prior to firing. Structures of this type are disclosed in the aforementioned application by Terrell and also in the above-described patent to Chammas. In the Chammas tool, since the cutting-head bore is open to the exterior of the tool and hence to the well fluid, the piston serves the function of closing off the lower portion of the bore, thus directing the chemical outwardly through the cutting ports. A configuration of this nature is subject to a severe disadvantage arising by virtue of the fact that, as the pressure within the tool decreases, the well-bore pressure may cause a reverse pressure differential which drives the piston upwardly. If the piston is moved to a point at which it again seals the cutting ports before the pressure in the tool falls sufficiently for retraction of the anchor means from the deployed position, the tool may become stuck in the hole.

In accordance with the present invention, this condition is guarded against through the use of a cutting section which is designed to actually lock the piston in the projected or fired position. Thus, even though a reverse pressure differential may develop, the piston is prevented from travelling backwardly to a position where it would prevent pressure release from the tool.

Figure 2:
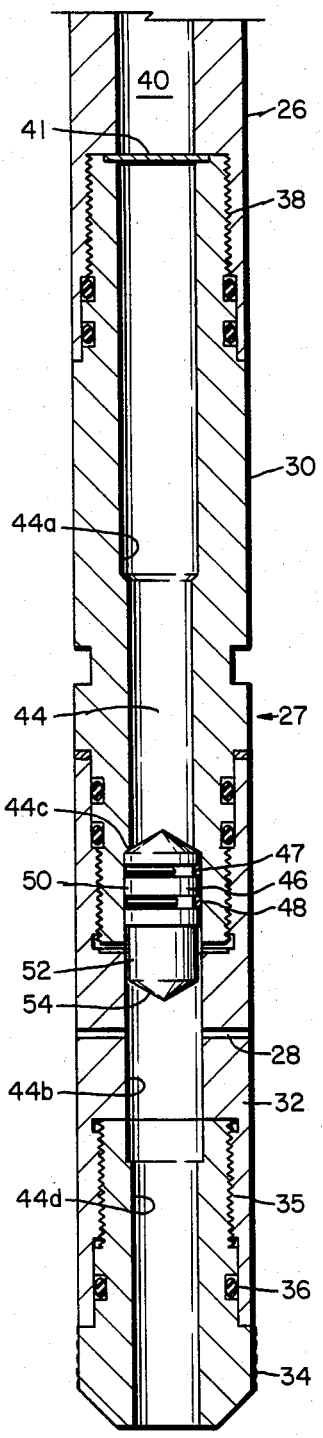
FIG. 2 is an illustration, partly in section, of a portion of the cutting tool illustrating an improved cutting head assembly.

Turning now to FIG. 2, there is shown an enlarged sectional view of the cutting section 27 which embodies an improved piston-head configuration and cutting-section locking means of the present invention.

As illustrated in FIG. 2, the cutting section comprises an ignitor sub 30, a head unit 32, and a head sub 34 threaded into the head unit by connection 35 which is provided with a suitable packing such as O-ring 36. The cutting section is connected by threads 38 to the chemical section 26. The chamber 40 defined by the wall of the chemical section contains a cutting fluid (not shown) which is held in place by means of a shear diaphragm 41. For the purposes of description, the portion of the cutting section secured to the chemical section will be referred to as the rear end of the cutting section and the portion of the cutting-head section defined by the head sub will be referred to as the front end of the cutting section.

The cutting section is provided with a longitudinally extending bore 44 which, discounting the rupturable shear diaphragm, is in fluid communication at the rear end of the cutting section with the chemical section. The front portion of the central bore is open to the exterior of the cutting tool through the head sub. The upper portion of the bore 44 is slightly enlarged as indicated by reference number **44*a* and is adapted to contain an ignitor hair (not shown) suitable for activation of the cutting fluid as described previously. The head unit of the cutting section is provided with the cutting ports 28. A piston plug 46 is located in the central bore and is equipped with O-rings 47 and 48. The portion of the central bore containing the piston is enlarged to provide a chamber 44*b*. Thus, the chamfered shoulder 44*c*** provides an abuttment preventing movement of the piston in the rear direction beyond the location shown.

Figure 3:
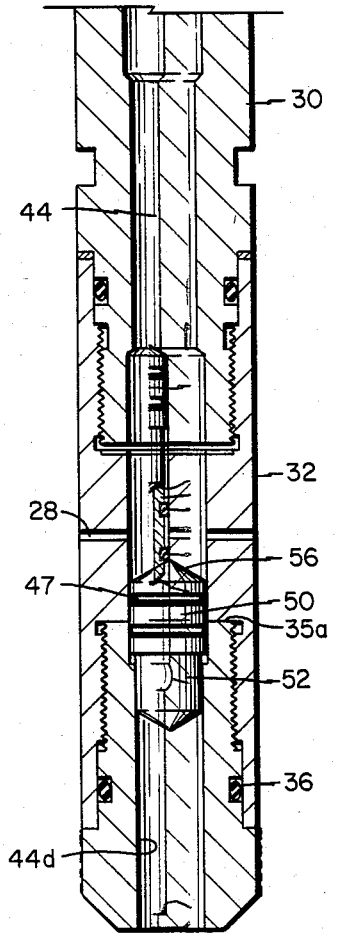
FIG. 3 is a side elevational view, partly in section, showing the cutting head assembly of FIG. 2 after the cutting tool has been fired.

In the embodiment of the invention illustrated in FIG. 2, the means to receive and hold the piston in place is provided by a slightly reduced portion, indicated by reference character **44*d*, of the cutting section bore. The reduced portion of the bore is dimensioned with respect to the diameter of the forward portion of the piston to provide an interference fit such that when the piston is driven forward by the expanding gas pressure, it becomes wedged in the reduced portion of the bore. This position of the piston is illustrated in FIG. 3 which is a side elevational view similarly as in FIG. 2**, but which shows the location of the piston after the tool has been fired. As there shown, the piston is wedged into place in the reduced portion of the bore such that it cannot be forced toward the chemical section even by exceedingly high pressure differentials.

In the embodiment shown, fluid communication between the bore and the exterior of the tool body is provided simply by extending the bore all the way through the head sub 34. This configuration usually will be preferred since well fluids such as drilling mud and the like which are accumulated in the lower portion of the bore can be easily driven out by the piston as it is fired. However, in some case it may desirable to provide a closure at the lower end of the head sub and then provide the fluid communication by means of transverse ports (not shown) drilled radially from the exterior of the head sub to the central bore. In this case the combined cross-sectional areas of such ports normally should be at least equal to the cross-sectional area of the bore section **44*b***.

As shown in FIGS. 2 and 3, it is preferred that the piston be formulated in two sections, the first, an enlarged back portion 50 equipped with suitable packing means such as the O-rings 47 and 48 and the other, a slightly reduced front portion 52 which is adapted to enter into the reduced section **44*d* of the cutting-head bore. By thus reducing the piston diameter slightly, minor misalignments between the piston, the enlarged section 44*b* of the bore, and the reduced section 44*d*, of the bore can be accommodated, thus facilitating entry of the piston into the reduced bore section. For a similar reason, it is also preferred to taper or bevel the front face 54** of the piston. The tapered piston surface can be formed by machining the piston to provide a conical front end as shown. Of course other suitable configurations can be employed. For example, the front end of the piston can be frusto conical, it only being necessary that there be sufficient bevel to facilitate entry of the piston into the reduced bore section.

The rear surface of the piston 46 is also beveled, although for reasons differently than that described above. The advantage of beveling the rear surface of the piston can best be seen from an examination of FIG. 3. As there illustrated, the beveled or tapered surface provided by the conical rear face of the face piston serves with the wall of the bore **44*b* to provide a configuration which enhances the flow of the chemical cutting fluid through the ports 28. The result is a somewhat greater penetration of the cutting fluid laterally from the tool, providing a somewhat greater stand-off distance, than would be the case in which the rear surface of the piston were flat. While this aspect of the invention is not to be limited by any theory of operation, it is believed that this greater lateral penetration effect is due to a reduction in turbulence as the cutting fluid flows from the bore outwardly through the ports 28**.

On examination of FIGS. 2 and 3 it can be seen that the piston, once it is wedged into place within the reduced bore section, will provide an effective seal against the chemical-cutting fluid, thus forcing the fluid out the head ports 28. Also, once the cutting action is completed, the piston provides a seal against well fluid entering the tool and travelling backwardly through the bore to prevent the release of pressure within the tool with the attendant retraction of the anchoring means. In addition, it is preferred to dimension the piston O-rings with respect to the reduced section of the bore so that at least one O-ring is behind the back end of the head sub indicated by reference numeral **35*a*. Thus, should there be leakage past the O-ring 36, the O-ring 47** in the piston will provide a secondary sealing means.

In the embodiment illustrated in FIGS. 2 and 3, the reduced section **44*d* of the bore should be only slightly smaller than the diameter of the forward portion 52 of the piston. Preferably the diameter of the reduced bore section is less than the diameter of the forward section of the piston plug by an increment of about 0.040 to 0.060". By way of example, the cutting-section components can have the following dimensions. The back portion of the piston has a diameter of 0.748/0.746" and the front portion of the piston is reduced to a diameter of 0.708/0.706". The enlarged portion 44*b* of the cutting-section bore has a diameter of 0.768/0.773". The reduced section 44*d*** of the cutting-section bore has a diameter of 0.658/0.663".

While the swedging of the piston into the reduced section of the bore can be accomplished by deformation of the wall of the head sub, by deformation of the piston, or by both, it will be preferred to form the piston plug of a relatively malleable material and form the head sub of a relatively hard material. For example, the piston can be formed of copper and the head sub of stainless steel. Using these materials and for an assembly having the dimensions described above, an internal tool pressure of about 15,000 psi will drive the piston into the reduced section of the bore by about $\frac{1}{8}$ to $\frac{1}{4}$ of an inch at a well pressure of about 5,000 psi.

Means other than those disclosed in FIGS. 2 and 3 may be employed to hold the piston in place in the front portion of the cutting tool. For example, the piston can be provided with a detent which engages an appropriately located groove in the wall of the bore in order to hold the piston in the general position shown in FIG. 3. Usually, however, the arrangement illustrated will be preferred from the standpoint of simplicity and reliability. After withdrawing the tool from the well, the piston can simply be pressed out of the head sub and the head sub then reused.

In the embodiment illustrated in FIGS. 2 and 3, the cutter ports are exposed to the circulation of well fluid through the front portion of the bore 44 as the tool is lowered into the well. While this usually will be an acceptable condition, in some cases it can lead to clogging of the cutting head ports thus interfering with proper operation of the tool. In a further embodiment of the invention, means are provided which reduces the likelihood of plugging of the cutting ports, while at the same time leaving the central cutting-section bore open to the well bore. This embodiment of the invention is illustrated in FIG. 4, which is a side elevational view of a modified cutting section, with the piston in an unfired position similarly as shown in FIG. 2.

Figure 4:
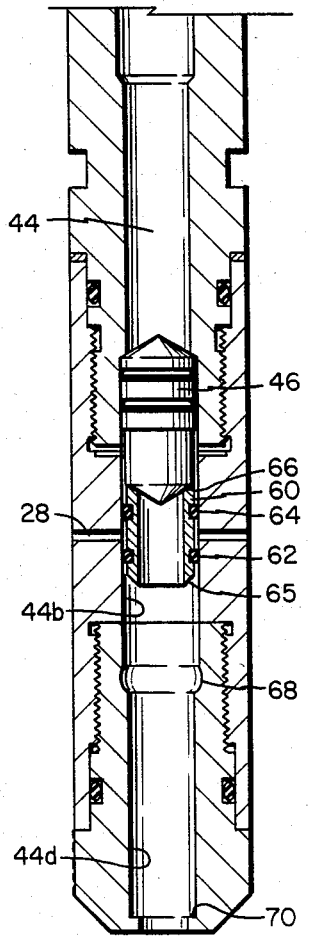
FIG. 4 is a side elevational view, partly in section, of a modified cutting head assembly.

As shown in FIG. 4, a sleeve 60 is positioned in the bore immediately in front of the piston 46. The sleeve is provided with packing means such as O-rings 62 and 64 which function to seal off the ports 28 against the flow of fluid from within the cutting-section bore. The interior passageway through the sleeve is open at both ends so that the sleeve will move readily through fluid within the cutting head bore when the tool is fired, forcing the piston 46 downwardly.

The sleeve is dimensioned so that it will move readily through the reduced section **44*d* of the cutting section bore. For example, in the example given previously where the section 44*d* has a nominal diameter of about 0.660" the sleeve may have an outer diameter of 0.650". The front edge of the sleeve is beveled as indicated by reference numeral 65 in order to facilitate entry of the sleeve into the bore section 44*d*. The back edge 66 of the sleeve is beveled inwardly in order to provide a configuration which conforms to the front face of the piston 46**.

As the sleeve enters the reduced bore section **44*d*, the O-rings 62, 64 will in many cases be cut or stripped from the sleeve. The portion of the cutting-head bore immediately in front of the reduced bore section 44*d* is provided with an annular recess 68. Recess 68 provides a receptacle for O-rings or O-ring fragments stripped from the sleeve so that the following piston 46 can readily enter the reduced bore section 44*d* as described previously. The front of the head sub 34 is also provided with a shoulder 70 which serves to catch the sleeve 60 to prevent it from being driven out of the tool and left in the well. In some cases it may be desirable to make sleeve 60 integral with the piston. In this case the shoulder 70** will be unnecessary and can be dispensed with.

Having described specific embodiments of the present invention, it will be understood that modifications thereof may be suggested to those skilled in the art, and it is intended to cover all such modifications as fall within the scope of the appended claims.

What is claimed is:

1. In a downhole chemical fluid jet cutting tool for cutting downhole tubular goods, the combination comprising:

(a) an elongated tool body adapted for insertion into a wellbore;

(b) anchoring means in said tool body, said anchoring means being actuatable between a deployed position in response to the application of fluid pressure and a retracted position in response to the release of said fluid pressure;

(c) a chemical section in said tool body having a chamber therein adapted to receive a cutting fluid;

(d) a cutting section in said tool body having a longitudinally extending bore in fluid communication with said chemical section at the rear of said cutting section and in fluid communication with the exterior of said tool body at the front of said cutting section;

(e) at least one cutting port at an intermediate location in said cutting section extending transversely from said bore to the exterior of said tool body;

(f) a piston formed of a relatively malleable material slidably disposed in said bore at a first position between said port and said chemical section; and (g) a reduced section in said bore in front of said port dimensioned with respect to said piston to receive said piston upon the application of fluid pressure in an interference fit to hold said piston in place at a second location in front of said cutting port, the wall of said reduced bore section being formed of a hard material relative to said piston.

2. The apparatus of claim 1 wherein said cutting section comprises a head sub at the front end thereof and a head unit secured to said head sub by a threaded connection and further comprising packing means on said piston at a position such that, when said piston is in said second location, said packing means is positioned behind said threaded connection.

3. The apparatus of claim 1 further comprising a sleeve slidably disposed in said bore in front of said piston adjacent said port and provided with packing means for sealing said port from the front portion of said bore, said sleeve having an outer diameter which is less than the diameter of said reduced bore section.

4. The apparatus of claim 3 further comprising a recess in the wall of said bore immediately adjacent the reduced section thereof and adapted to receive said packing means or portions thereof.

5. The apparatus of claim 1 wherein the front face of said piston is tapered toward the front of said cutting section to facilitate entry of said piston into said reduced bore section.

6. In a downhole chemical fluid jet cutting tool for cutting downhole tubular goods, the combination comprising:

(a) an elongated tool body adapted for insertion into a wellbore;

(b) anchoring means in said tool body, said anchoring means being actuatable between a deployed position in response to the application of fluid pressure and a retracted position in response to the release of said fluid pressure;

(c) a chemical section in said tool body having a chamber therein adapted to receive a cutting fluid;

(d) a cutting section in said tool body having a longitudinally extending bore in fluid communication with said chemical section at the rear of said cutting section and in fluid communication with the exterior of said tool body at the front of said cutting section, said bore comprising an enlarged diameter rear bore section and a smaller diameter front bore section;

(e) at least one cutting port at an intermediate location in said cutting section extending transversely from said enlarged diameter rear bore section to the exterior of said tool body; and (f) a piston slidably disposed in said bore at a location between said port and said chemical section, said piston comprising an enlarged back portion and a reduced front portion having a diameter slightly larger than the diameter of said front bore section whereby upon the application of fluid pressure to said piston, said piston is received into said front bore section in an interference fit to hold said piston in place in front of said cutting port, and the reduced front portion of said piston having a front face which is tapered toward the front of said cutting section to facilitate entry of the reduced front portion of said piston into said smaller diameter front bore section.

7. The apparatus of claim 6 further comprising a shoulder in said smaller diameter front bore section.

8. The apparatus of claim 6 wherein the surface of said piston facing said chemical section is tapered toward the rear of said cutting section.

9. The apparatus of claim 6 further comprising a sleeve slidably disposed in said bore in front of said piston adjacent said port and provided with packing means for sealing said port from the front portion of said bore, said sleeve having an outer diameter which is less than the diameter of said reduced bore section.

10. The apparatus of claim 9 further comprising a recess in the wall of said bore immediately adjacent the reduced section thereof and adapted to receive said packing means or portions thereof.

11. The apparatus of claim 10 further comprising a shoulder in the reduced portion of said bore at the front of said chemical section to provide a stop for said sleeve.

12. In a downhole chemical fluid jet cutting tool for cutting downhole tubular goods, the combination comprising:

(a) an elongated tool body adapted for insertion into a wellbore;

(b) anchoring means in said tool body, said anchoring means being actuatable between a deployed position in response to the application of fluid pressure and a retracted position in response to the release of said fluid pressure;

(c) a chemical section in said tool body having a chamber therein adapted to receive a cutting fluid;

(d) a cutting section in said tool body having a longitudinally extending bore in fluid communication with said chemical section at the rear of said cutting section and in fluid communication with the exterior of said tool body at the front of said cutting section;

(e) at least one cutting port at an intermediate location in said cutting section extending transversely from said bore to the exterior of said tool body;

(f) a piston slidably disposed in said bore at a first location between said port and said chemical section in which said piston is wholly behind said port;

(g) means in said bore in front of said port to receive said piston upon the application of fluid pressure to hold said piston in place at a second location in front of said cutting port; and (h) displaceable sealing means separate from said piston and disposed in said bore in front of said piston and adjacent said port to seal said port against the circulation of well fluid, said sealing means being displaceable from said port upon the application of fluid pressure.

13. The apparatus of claim 12 wherein said sealing means comprises a sleeve slidably disposed in said bore in front of said piston adjacent said port and provided with packing means for sealing said port from the front portion of said bore, said sleeve being adapted to be driven past said receiving means by said piston when said piston is driven to the second location.

14. In a downhole chemical fluid jet cutting tool for cutting downhole tubular goods, the combination comprising:

(a) an elongated tool body adapted for insertion into a wellbore;

(b) anchoring means in said tool body, said anchoring means being actuatable between a deployed position in response to the application of fluid pressure and a retracted position in response to the release of said fluid pressure;

(c) a chemical section in said tool body having a chamber therein adapted to receive a cutting fluid;

(d) a cutting section in said tool body having a longitudinally extending bore in fluid communication with said chemical section at the rear of said cutting section and in fluid communication with the exterior of said tool body at the front of said cutting section;

(e) at least one cutting port at an intermediate location in said cutting section extending transversely from said bore to the exterior of said tool body;

(f) a piston slidably disposed in said bore at a first location between said port and said chemical section and having a back surface facing said chemical section which is tapered toward the rear of said cutting section; and (g) means in said bore in front of said port to receive said piston upon the application of fluid pressure to hold said piston in place at a second location in front of said cutting port.

15. In a downhole chemical fluid jet cutting tool for cutting downhole tubular goods, the combination comprising:

(a) an elongated tool body adapted for insertion into a wellbore;

(b) anchoring means in said tool body, said anchoring means being actuatable between a deployed position in response to the application of fluid pressure and a retracted position in response to the release of said fluid pressure;

(c) a chemical section in said tool body having a chamber therein adapted to receive a cutting fluid;

(d) a cutting section in said tool body having a longitudinally extending bore in fluid communication with said chemical section at the rear of said cutting section and in fluid communication with the exterior of said tool body at the front of said cutting section, said bore comprising an enlarged diameter cylindrical rear bore section and a smaller diameter cylindrical front bore section;

(e) at least one cutting port at an intermediate location in said cutting section extending transversely from said enlarged diameter rear bore section to the exterior of said tool body; and (f) a piston slidably disposed in said bore at a location between said port and said chemical section, said piston comprising an enlarged cylindrical back portion and a reduced cylindrical front portion the diameter of the front portion of said piston being slightly larger than the diameter of said front bore section whereby upon the application of fluid pressure to said piston, the cylindrical front portion of said piston is received into said cylindrical front bore section in an interference fit to hold said piston in place in front of said cutting port.

16. The apparatus of claim 15 wherein the cylindrical front portion said piston is formed of a relatively malleable material and the wall of said smaller diameter cylindrical front bore section is formed of a relatively hard material.

17. The apparatus of claim 16 wherein the front face of the reduced cylindrical front portion of said piston is tapered toward the front of said cutting section to facilitate entry of the reduced cylindrical front portion of said piston into said smaller diameter cylindrical front bore section.

18. In a downhole chemical fluid jet cutting tool for cutting downhole tubular goods, the combination comprising:

(a) an elongated tool body adapted for insertion into a wellbore;

(b) anchoring means in said tool body, said anchoring means being actuatable between a deployed position in response to the application of fluid pressure and a retracted position in response to the release of said fluid pressure;

(c) a chemical section in said tool body having a chamber therein adapted to receive a cutting fluid;

(d) a cutting section in said tool body having a longitudinally extending bore in fluid communication with said chemical section at the rear of said cutting section and in fluid communication with the exterior of said tool body at the front of said cutting section, said bore comprising an enlarged diameter rear bore section and a smaller diameter front bore section, the wall of said front bore section being formed of a relatively hard material;

(e) at least one cutting port at an intermediate location in said cutting section extending transversely from said enlarged diameter rear bore section to the exterior of said tool body; and (f) a piston slidably disposed in said bore at a location between said port and said chemical section, said piston being formed of a relatively malleable material in relation to the wall of said front bore section and comprising an enlarged back portion and a reduced front portion having a diameter slightly larger than the diameter of said front bore section whereby upon the application of fluid pressure to said piston, said piston is received into said front bore section in an interference fit to hold said piston in place in front of said cutting port.

19. In a downhole chemical fluid jet cutting tool for cutting downhole tubular goods, the combination comprising:

(a) an elongated tool body adapted for insertion into a wellbore;

(b) anchoring means in said tool body, said anchoring means being actuatable between a deployed position in response to the application of fluid pressure and a retracted position in response to the release of said fluid pressure;

(c) a chemical section in said tool body having a chamber therein adapted to receive a cutting fluid;

(d) a cutting section in said tool body having a longitudinally extending bore in fluid communication with said chemical section at the rear of said cutting section and in fluid communication with the exterior of said tool body at the front of said cutting section, said bore comprising an enlarged diameter rear bore section and a smaller diameter front bore section;

(e) at least one cutting port at an intermediate location in said cutting section extending transversely from said enlarged diameter rear bore section to the exterior of said tool body;

(f) a piston slidably disposed in said bore at a location between said port and said chemical section, said piston comprising an enlarged back portion and a reduced front portion having a diameter slightly larger than the diameter of said front bore section whereby upon the application of fluid pressure to said piston, said piston is received into said front bore section in an interference fit to hold said piston in place in front of said cutting port; and (g) displaceable sealing means separate from said piston and disposed in said bore in front of said piston and adjacent said port to seal said port against circulation of well fluid, said sealing means being displaceable from said port upon the application of fluid pressure.

* * * * *